US011262078B2

(12) United States Patent
Ha et al.

(10) Patent No.: US 11,262,078 B2
(45) Date of Patent: Mar. 1, 2022

(54) KNOB ASSEMBLY WITH DISPLAY DEVICE AND COOKING APPARATUS HAVING KNOB ASSEMBLY

(71) Applicant: LG ELECTRONICS INC., Seoul (KR)

(72) Inventors: Yeonsik Ha, Seoul (KR); Seong Sik Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/118,882

(22) Filed: Dec. 11, 2020

(65) Prior Publication Data

US 2021/0095856 A1 Apr. 1, 2021

Related U.S. Application Data

(62) Division of application No. 15/899,583, filed on Feb. 20, 2018, now Pat. No. 10,890,330.

(30) Foreign Application Priority Data

Feb. 22, 2017 (KR) ..... 10-2017-0023774

(51) Int. Cl.
*F24C 3/12* (2006.01)
*H01H 19/14* (2006.01)
(Continued)

(52) U.S. Cl.
CPC ..... *F24C 3/124* (2013.01); *F24C 3/126* (2013.01); *G05G 1/12* (2013.01); *H01H 3/0206* (2013.01);
(Continued)

(58) Field of Classification Search
CPC ..... F24C 3/124; F24C 3/126; G05G 1/12; H01H 19/025; H01H 19/14; H01H 3/10;
(Continued)

(56) References Cited

U.S. PATENT DOCUMENTS 98,885 A 1/1870 Roberts
113,455 A 4/1871 Scrannage et al.
(Continued)

FOREIGN PATENT DOCUMENTS

CN 103069227 4/2013
CN 105757133 7/2016
(Continued)

OTHER PUBLICATIONS

European Search Report dated Jun. 7, 2021 issued in Application No. 20201468.4.
(Continued)

*Primary Examiner* — Liliana Cerullo
(74) *Attorney, Agent, or Firm* — Ked & Associates LLP

(57) ABSTRACT

A knob assembly with a display that displays information such as power level and a timer time, and a cooking apparatus including a knob assembly are provided. The knob assembly may include a knob coupled to an adjustment shaft configured to adjust power level and a knob ring configured to surround a periphery of the knob, configured to be rotatable independent of the knob, and provided with a display. The display may be provided at the knob ring, and information may be displayed on the display so that a user may easily manipulate the knob assembly.

20 Claims, 12 Drawing Sheets

(51) Int. Cl.

| | |
|---|---|
| *G05G 1/12* | (2006.01) |
| *H01H 19/02* | (2006.01) |
| *H01H 3/10* | (2006.01) |
| *H01H 3/02* | (2006.01) |
| *H01H 9/18* | (2006.01) |

(52) U.S. Cl.
CPC ..... *H01H 3/10* (2013.01); *H01H 9/181* (2013.01); *H01H 19/025* (2013.01); *H01H 19/14* (2013.01); *H01H 2003/105* (2013.01); *H01H 2019/143* (2013.01)

(58) Field of Classification Search
CPC ..... H01H 3/0206; H01H 2003/105; H01H 2019/143
See application file for complete search history.

(56) References Cited

U.S. PATENT DOCUMENTS

| | | | |
|---|---|---|---|
| 577,992 | A | 3/1897 | Switzer |
| 636,758 | A | 11/1899 | Casaday |
| 676,118 | A | 6/1901 | Billings |
| 956,912 | A | 5/1910 | Walters |
| 1,358,467 | A | 11/1920 | Robertson |
| 1,491,186 | A | 4/1924 | Bartlett |
| 1,553,312 | A | 9/1925 | Garrecht |
| 1,604,699 | A | 10/1926 | Lacroix |
| 1,689,955 | A | 10/1928 | Meacham |
| 1,898,265 | A | 2/1933 | Ragan |
| 1,947,965 | A | 2/1934 | Beggs |
| 1,981,084 | A | 11/1934 | Teller |
| 2,147,141 | A | 2/1939 | Blancha |
| 2,174,342 | A | 9/1939 | Greulich |
| 2,288,425 | A | 6/1942 | Simborg |
| 2,539,840 | A | 1/1951 | Jones |
| 2,626,661 | A | 1/1953 | McDowell |
| 2,631,704 | A | 3/1953 | De Wiess |
| 2,658,979 | A | 11/1953 | Jungholm |
| 2,667,768 | A | 2/1954 | Winkler |
| 2,708,888 | A | 5/1955 | Varney |
| 2,738,758 | A | 3/1956 | Cutler et al. |
| 2,832,409 | A | 4/1958 | Lee et al. |
| 2,837,154 | A | 6/1958 | Harper et al. |
| 2,865,594 | A | 12/1958 | Winfree |
| 2,895,314 | A | 7/1959 | Helm |
| 2,899,808 | A | 8/1959 | Berens |
| 2,945,364 | A | 7/1960 | Marquis |
| 2,983,119 | A | 5/1961 | Glover |
| 3,212,290 | A | 10/1965 | Walden |
| 3,304,001 | A | 2/1967 | Forte |
| 3,528,263 | A | 9/1970 | Stern |
| 3,572,055 | A | 3/1971 | Billey |
| 3,595,273 | A | 7/1971 | Kolodziej |
| 3,609,994 | A | 10/1971 | Colletti et al. |
| 3,621,158 | A | 11/1971 | Swinstead |
| 3,844,137 | A | 10/1974 | Zugel |
| 3,858,129 | A | 12/1974 | Ashida et al. |
| 4,065,941 | A | 1/1978 | Aoki |
| 4,092,871 | A | 6/1978 | Cunningham |
| 4,449,955 | A | 5/1984 | Watanabe et al. |
| 4,540,383 | A | 9/1985 | Taig |
| 4,692,127 | A | 9/1987 | Wagner |
| 4,868,530 | A | 9/1989 | Ahs |
| 4,964,840 | A | 10/1990 | Kapaan |
| 5,284,455 | A | 2/1994 | Kuribayashi |
| 5,436,413 | A | 7/1995 | Katakami |
| 5,458,028 | A | 10/1995 | Cleveland, III |
| 5,665,946 | A | 9/1997 | Nishijima et al. |
| 5,693,245 | A | 12/1997 | Clizbe |
| 6,031,439 | A | 2/2000 | Adams et al. |
| 6,325,724 | B1 | 12/2001 | Sato |
| 6,621,016 | B2 | 9/2003 | Ohba et al. |
| 6,627,828 | B1 | 9/2003 | McCartney |
| 7,171,727 | B2 | 2/2007 | Wylie et al. |
| 7,479,607 | B2 | 1/2009 | Sack et al. |
| 8,079,287 | B2 | 12/2011 | Castillo |
| 8,783,646 | B2 | 7/2014 | Wasser |
| 8,997,591 | B1 | 4/2015 | Vircks |
| 9,593,855 | B2 | 3/2017 | Moro et al. |
| 9,646,783 | B1 | 5/2017 | Stoufer et al. |
| 10,248,153 | B2 | 4/2019 | Stoufer et al. |
| 10,288,065 | B1 | 5/2019 | Smid |
| 10,466,736 | B2 | 11/2019 | Stoufer |
| 10,746,409 | B2 | 8/2020 | Ha |
| 2004/0070574 | A1 | 4/2004 | Wylie et al. |
| 2007/0181410 | A1 | 8/2007 | Baier |
| 2008/0053806 | A1 | 3/2008 | Stoffers et al. |
| 2008/0121067 | A1 | 5/2008 | Uhlin |
| 2009/0263186 | A1 | 10/2009 | Hofmann |
| 2009/0293654 | A1 | 12/2009 | Pintauro |
| 2010/0043499 | A1 | 2/2010 | Choi et al. |
| 2010/0265176 | A1 | 10/2010 | Olsson et al. |
| 2011/0005508 | A1 | 1/2011 | Albizuri |
| 2012/0115096 | A1 | 5/2012 | Gadini et al. |
| 2012/0204854 | A1 | 8/2012 | Dondurur et al. |
| 2012/0215475 | A1 | 8/2012 | Rutledge et al. |
| 2013/0137526 | A1 | 5/2013 | Sugiyama |
| 2014/0260775 | A1 | 9/2014 | Freeman et al. |
| 2015/0005081 | A1 | 1/2015 | Harnetiaux |
| 2015/0122134 | A1 | 5/2015 | Moro et al. |
| 2015/0153047 | A1 | 6/2015 | Moro et al. |
| 2015/0153048 | A1 | 6/2015 | Moro et al. |
| 2016/0053803 | A1 | 2/2016 | Yu |
| 2016/0097541 | A1 | 4/2016 | Choi |
| 2016/0170436 | A1 | 6/2016 | Farrar et al. |
| 2016/0265786 | A1 | 9/2016 | Choi |
| 2016/0333990 | A1 | 11/2016 | Edinger et al. |
| 2016/0333991 | A1 | 11/2016 | Edinger et al. |
| 2017/0083039 | A1 | 3/2017 | Wuisan et al. |
| 2017/0235326 | A1 | 8/2017 | Koschinat |
| 2017/0351292 | A1 | 12/2017 | Stoufer et al. |
| 2018/0210484 | A1 | 7/2018 | Stoufer |
| 2018/0239386 | A1 | 8/2018 | Ha |
| 2018/0259996 | A1 | 9/2018 | Stoufer et al. |
| 2019/0024903 | A1 | 1/2019 | Ha |
| 2019/0101949 | A1 | 4/2019 | Takizawa et al. |
| 2019/0170360 | A1 | 6/2019 | Ha et al. |

FOREIGN PATENT DOCUMENTS

| | | |
|---|---|---|
| DE | 3940378 | 6/1990 |
| DE | 102 55 676 | 6/2004 |
| DE | 10-2005-045300 | 9/2006 |
| DE | 10-2007-035564 | 1/2009 |
| EP | 0 412 041 | 2/1991 |
| EP | 0 584 400 | 3/1994 |
| EP | 1 420 181 | 5/2004 |
| EP | 1881514 | 1/2008 |
| EP | 1 962 167 | 8/2008 |
| EP | 2 088 357 | 8/2009 |
| EP | 2 587 161 | 5/2013 |
| EP | 2 703 671 | 3/2014 |
| EP | 3 492 815 | 6/2019 |
| EP | 3493721 | 6/2019 |
| GB | 322884 | 12/1929 |
| GB | 2 081 874 | 2/1982 |
| GB | 2 178 134 | 2/1987 |
| JP | S 5660922 | 5/1981 |
| JP | S56-77793 | 6/1981 |
| JP | S 5761860 | 4/1982 |
| JP | 60065909 | 4/1985 |
| JP | 60249729 | 12/1985 |
| JP | H 01-136723 | 9/1989 |
| JP | 2716246 | 2/1998 |
| JP | H10-258694 | 9/1998 |
| JP | H 11-000140 | 11/1999 |
| JP | 2006-118539 | 5/2006 |
| JP | 2012-003588 | 1/2012 |
| JP | 2015-190560 | 11/2015 |
| JP | 2016-217593 | 12/2016 |
| JP | 2017-157397 | 9/2017 |
| KR | 20-1989-0013720 | 8/1989 |
| KR | 10-1994-0026468 | 12/1994 |

(56) References Cited

FOREIGN PATENT DOCUMENTS

| | | |
|---|---|---|
| KR | 10-1998-0021844 | 6/1998 |
| KR | 10-1998-0020482 | 7/1998 |
| KR | 10-1998-0052401 | 10/1998 |
| KR | 20-1998-0052401 | 10/1998 |
| KR | 10-0175848 | 3/1999 |
| KR | 10-1999-0031371 | 5/1999 |
| KR | 10-2000-0008085 | 2/2000 |
| KR | 20-2000-0006636 | 4/2000 |
| KR | 20-0181156 | 5/2000 |
| KR | 20-0193805 | 8/2000 |
| KR | 10-2003-0047508 | 6/2003 |
| KR | 10-2005-0104447 | 11/2005 |
| KR | 10-2006-0035373 | 4/2006 |
| KR | 10-2007-0064981 | 6/2007 |
| KR | 10-2007-0077412 | 7/2007 |
| KR | 10-0854156 | 8/2008 |
| KR | 10-0941463 | 2/2010 |
| KR | 10-1140121 | 4/2012 |
| KR | 10-2012-0140490 | 12/2012 |
| KR | 10-2015-0128172 | 11/2015 |
| WO | WO 2010/134040 | 11/2010 |
| WO | WO 2013/175438 | 11/2013 |
| WO | WO 2013/175441 | 11/2013 |
| WO | WO 2015/008092 | 1/2015 |
| WO | WO 2015/171503 | 11/2015 |

OTHER PUBLICATIONS

Korean Office Action dated May 26, 2021 issued in KR Application No. 10-2021-0048242.
Korean Notice of Allowance dated Aug. 13, 2021 issued in KR Application No. 10-2021-0048242.
Korean Notice of Allowance dated Jan. 13, 2021 issued in Application No. 10-2020-0045531.
Korean Office Action dated Mar. 9, 2021 issued in Application No. 10-2021-0008599.
Korean Notice of Allowance dated Apr. 5, 2021 issued in Application No. 10-2020-0048575.
U.S. Appl. No. 17/118,882, filed Dec. 11, 2020.
U.S. Appl. No. 16/911,896, filed Jun. 25, 2020.
U.S. Appl. No. 16/986,942, filed Aug. 6, 2020.
U.S. Appl. No. 16/923,566, filed Jul. 8, 2020.
European Search Report dated Jul. 18, 2018 issued in Application No. 18157319.7.
European Search Report dated Jul. 18, 2018 issued in Application No. 18157431.0.
European Search Report dated Jul. 19, 2018 issued in Application No. 18157306.4.
European Search Report dated Jul. 19, 2018 issued in Application No. 18157312.2.
Korean Notice of Allowance dated Jul. 20, 2018 issued in Application No. 10-2017-0023774.
European Search Report dated Oct. 10, 2018 issued in Application No. 18157383.3.
European Search Report dated Nov. 27, 2018 issued in Application No. 18157306.4.
European Office Action dated Aug. 5, 2019.
Korean Office Action dated Aug. 20, 2019.
U.S. Office Action dated Aug. 21, 2019 issued in co-pending U.S. Appl. No. 15/899,797.
U.S. Office Action dated Dec. 11, 2019 issued in U.S. Appl. No. 15/899,637.
Korean Notice of Allowance dated Jan. 13, 2020 issued in Application No. 10-2017-0093734.
Korean Notice of Allowance dated Jan. 13, 2020 issued in Application No. 10-2017-0167073.
Korean Office Action dated Jan. 21, 2020 issued in Application No. 10-2017-0094806.
United States Office Action dated Jan. 24, 2020 issued in co-pending related U.S. Appl. No. 15/899,730.
European Search Report dated Feb. 24, 2020 issued in Application No. 19209191.6.
Chinese Office Action dated Mar. 4, 2020 issued in Application No. 201811486621.X.
Korean Office Action dated Apr. 9, 2020 issued in Application No. 10-2018-0136829.
Korean Office Action dated Apr. 26, 2020 issued in KR Application No. 10-2018-0152988.
U.S. Office Action dated Jun. 5, 2020 issued in U.S. Appl. No. 15/899,507.
Korean Office Action dated Jul. 29, 2020 issued in KR Application No. 10-2017-0094806.
U.S. Notice of Allowance dated Sep. 9, 2020 issued in U.S. Appl. No. 15/899,583.
Korean Office Action dated Oct. 17, 2020 issued in KR Application No. 10-2018-0136829.
Korean Office Action dated Oct. 17, 2020 issued in KR Application No. 10-2018-0152988.
European Search Report dated Jan. 25, 2021 issued in EP Application No. 20201469.2.
European Search Report dated Jan. 25, 2021 issued in EP Application No. 20201473.4.
European Search Report dated Jan. 26, 2021 issued in EP Application No. 20201471.8.
United States Office Action dated Nov. 19, 2021 issued in co-pending related U.S. Appl. No. 16/911,896.
Korean Notice of Allowance dated Sep. 28, 2021.

KNOB ASSEMBLY WITH DISPLAY DEVICE AND COOKING APPARATUS HAVING KNOB ASSEMBLY

CROSS-REFERENCE TO RELATED APPLICATION

This application is a Divisional Application of prior U.S. patent application Ser. No. 15/899,583 filed Feb. 20, 2018, which claims priority under 35 U.S.C. § 119 to Korean Application No. 10-2017-0023774 filed on Feb. 22, 2017, whose entire disclosures are hereby incorporated by reference.

BACKGROUND

1. Field

A knob assembly with a display and a cooking apparatus having a knob assembly are disclosed herein.

2. Background

A cooking apparatus is a kind of home appliance that cooks food or other items (hereinafter "food") and may be installed or provided in a kitchen space. Such cooking apparatuses may be classified into various categories according to heat source, form or shape thereof, and type of fuel used in the cooking apparatus. The cooking apparatus may be classified as an open-type cooking apparatus and/or a closed-type cooking apparatus according to a space in which food is placed. The closed-type cooking apparatus may include an oven, or a microwave oven, for example, and the open-type cooking apparatus may include a cooktop, or a hob, for example.

The closed-type cooking apparatus may be a cooking apparatus configured to enclose a space in which food may be placed and may heat the enclosed space to cook the food. The open-type cooking apparatus may be a cooking apparatus in which food or a vessel containing food may be placed in an open space and may be configured to heat the food or the vessel to cook the food.

The closed-type cooking apparatus may be provided with a cooking chamber, in which the food may be placed and which may be a space which is enclosed when the food is cooked. Food may be cooked in the cooking chamber. A heat source may be provided in a space inside or outside of the cooking chamber to heat the cooking chamber.

A composite cooking apparatus may be provided in which a closed-type cooking apparatus and an open-type cooking apparatus may be installed and a plurality of heat sources may be combined to simultaneously cook a plurality of foods. In the composite cooking apparatus, the open-type cooking apparatus may be located above the closed-type cooking apparatus. A plurality of heaters or burners may be installed at or provided on the open-type cooking apparatus so that the open-type cooking apparatus may be able to simultaneously cook a plurality of foods.

A user may use the closed-type cooking apparatus when cooking food, such as, for example, barbecued food or baked goods or grilled food, and may use the open-type cooking apparatus which is exposed above the closed-type cooking apparatus when cooking food which may be accommodated and heated in a vessel or container. The open-type cooking apparatus may be a gas range, and such an open-type cooking apparatus may cook food using a flame generated when a gas burns.

A variety of methods may be provided to enable a user to adjust a strength of a flame of such an open-type cooking apparatus. A method of adjusting a power level by using a knob, which may rotate around a predetermined rotational shaft, to adjust a rotational amount of the knob may be widely used. The knob may be connected to a valve that controls a flow rate of a gas to mechanically control opening and closing amounts of the valve. A method of electronically measuring a rotational amount of the knob and electronically controlling the opening and closing amounts of the valve based on the measured result may also be applied to the knob.

A cooking apparatus or composite cooking apparatus including an oven may be provided with a display or module which may display a timer time, and an operating state, for example. In an oven required to cook food for a long time, a timer function may be necessary, a dial-type timer may be employed in the oven, and a structure capable of displaying status information of the cooking apparatus through a separate display may be provided.

Even though the cooking apparatus is provided with the same cooktop, the display may not be necessary when only a gas range is provided at the cooking apparatus, but in the composite cooking apparatus, the display may be needed so as to display various information. However, information displayed by individual products may be different, and designs of a screen of a display, and a user interface (UI), for example, may be separately developed.

BRIEF DESCRIPTION OF THE DRAWINGS

Embodiments will be described in detail with reference to the following drawings in which like reference numerals refer to like elements, and wherein.

DETAILED DESCRIPTION

Figure 1:
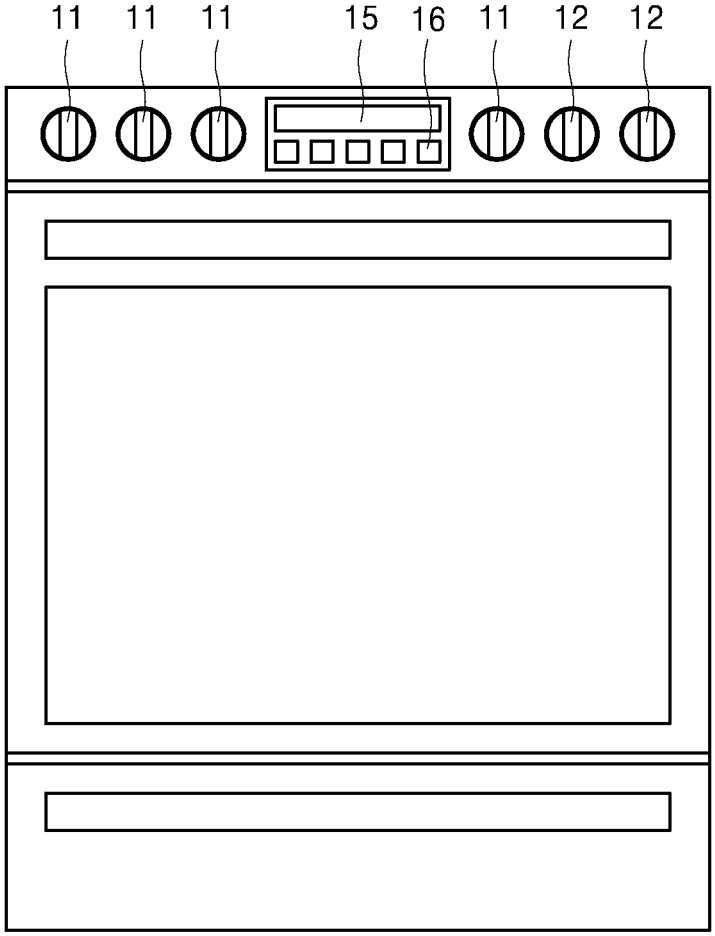
FIG. 1 is a view of a cooking apparatus provided with a separate display.
Figure 2:
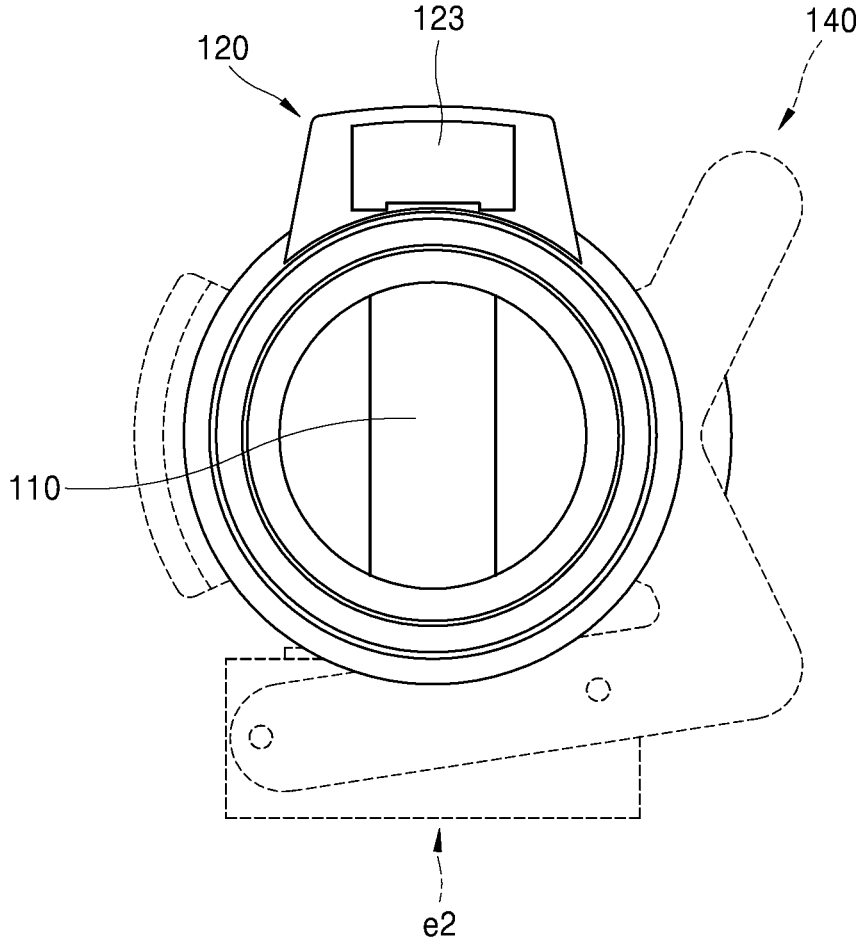
FIG. 2 is a view of a front surface of a knob assembly according to an embodiment.
Figure 3:
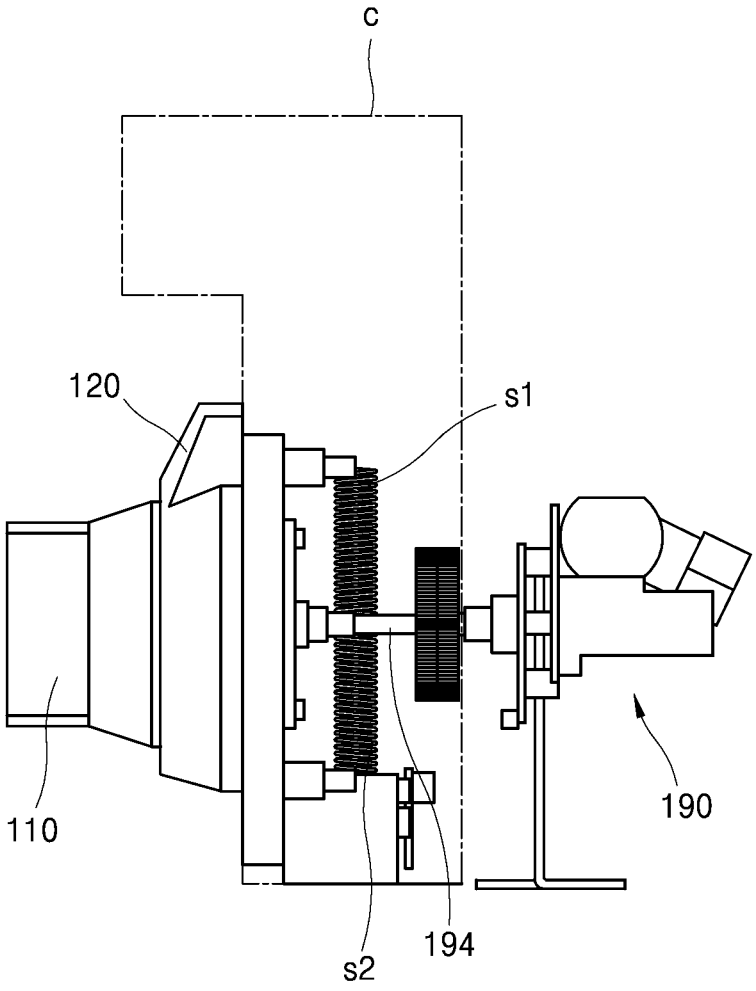
FIG. 3 is a side view of a cross section of the knob assembly of FIG. 2.
Figure 4:
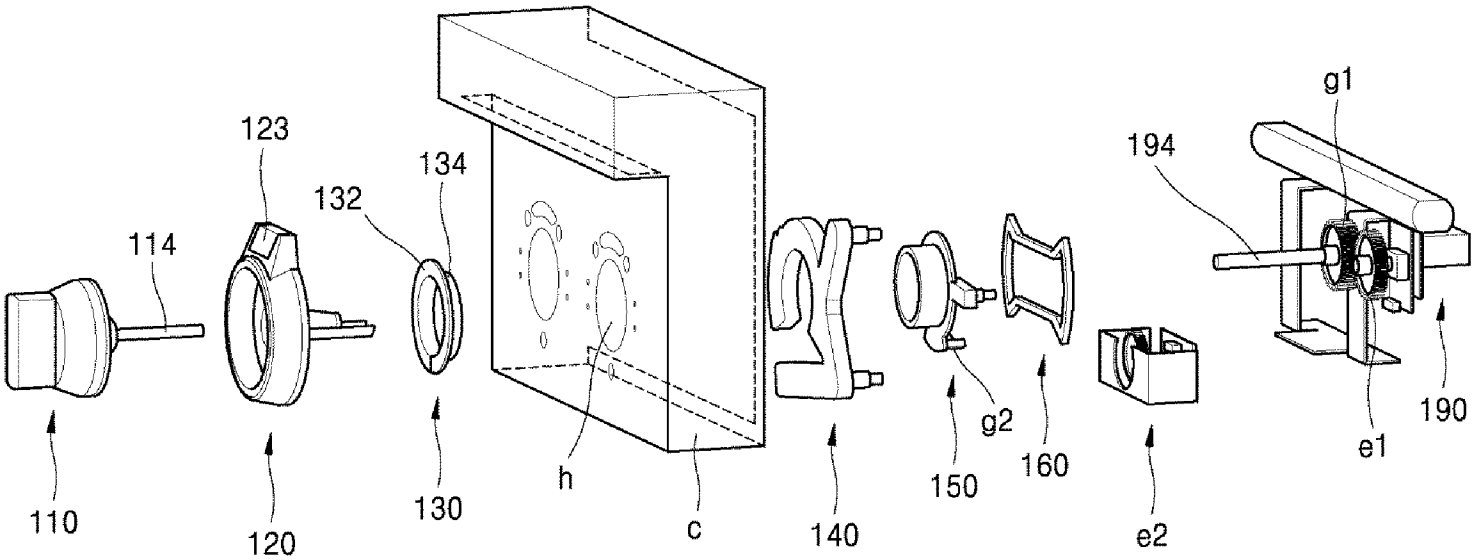
FIG. 4 is an exploded view of a components of the knob assembly of FIG. 2.
Figure 5:
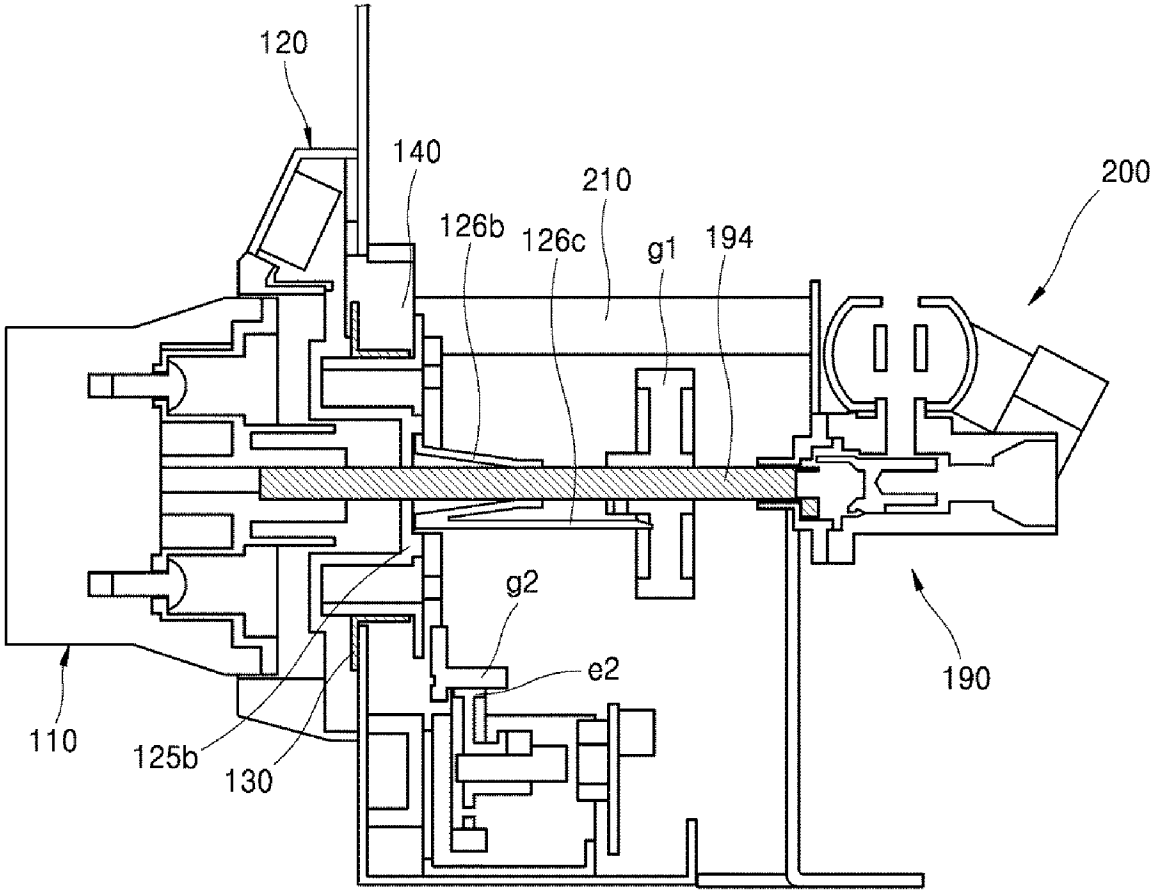
FIG. 5 is a cross-sectional view of the knob assembly of FIG. 2.

Referring to FIG. 1, a cooking apparatus 10 may be provided with an oven which may include knobs 11 configured to adjust a power level, knobs 12 configured to adjust a timer time, a display or module 15 configured to display a status of the cooking apparatus 10, and switches 16 configured to each perform a separate operation or manipulation, at a front surface of the cooking apparatus 10. As the oven may be required to cook food for a long time, a timer that sets an operating time of the oven may be necessary. For unity of design and convenience of manipulation, a rotary switch may be applied to the knob 11 configured to adjust a power level and the knob 12 configured to adjust a timer time.

The display 15 may display an operation or manipulation state, for example, of the cooking apparatus 10. Information displayed on the display 15 may include an output, for example, a temperature of a burner, the timer time, and a cooking mode of an automatic cooking function, for example. However, if a configuration of a flame hole of the cooking apparatus 10 is changed or a specification of a product is changed, information or a user interface (UI), which may be displayed on the display 15, may be changed, and the display 15 may be separately designed.

As the knob 11 configured to adjust power level and the knob 12 configured to adjust a timer time may have a same or similar shape, the knobs 11 and 12 may be superior in terms of design, but in terms of user convenience, it may be difficult for a user to recognize which knob performs which function. To resolve the above-described problems, a knob assembly may be provided that includes a knob handle configured to adjust a power level of a cooking apparatus and a knob ring configured to adjust a timer time, for example, of the cooking apparatus. A display may be provided at the knob ring so that the knob assembly may be easily used by a user and may have a superior design and an advantage in terms of component sharing.

Referring to FIG. 2 through FIG. 5, a knob handle or knob 110 may be connected to an adjustment shaft 194 of a power level adjuster or heat adjuster 190 configured to adjust a power level. The knob handle 110 may include a non-returning rotary switch such that the non-returning rotary switch may not return to an initial position once it is rotated by an external force. The knob handle 110 may be maintained at a position at which a user rotates the knob handle 110, and allow an output of power or flame at a corresponding flame hole according to a rotational angle of the knob handle 110. That is, a position of the knob handle 110 may correspond to how much power is released from a heat source of the cooking apparatus. For example, in a case of a gas burner, the power level adjuster 190 may be a valve, and in the case of a microwave oven or an induction range, the power level adjuster 190 may be an output adjuster, such as a variable resistor, in order to adjust an output thereof.

The knob handle 110 may have a circular shape and may be provided with a protruding handle. The protruding handle may be bar-shaped, but a shape of the handle may be variously modified and embodiments are not limited thereto. The knob handle 110 may be, for example, manufactured of a synthetic resin injection material or may be manufactured by processing a metal material. A material and shape of the knob handle 110 may be variously changed.

A knob ring 120 may be provided at an outer circumferential surface of the knob handle 110 to improve an exterior appearance of a periphery of the knob handle 110. The knob ring 120 may support the knob handle 110 and may finish the exterior appearance of the periphery of the knob handle 110 to improve a quality of the exterior appearance.

The knob ring 120 may confine or restrict a position of the knob handle 110. The power level adjuster 190 may be applied or coupled to the adjustment shaft 194, and if the knob handle 110 is coupled to only the adjustment shaft 194, the knob handle 110 may arbitrarily move in different directions. The knob ring 120 according to embodiments may confine or restrict the position of the knob handle 110 and may allow the knob handle 110 to be maintained at a certain or set position.

The knob ring 120 may include a timer manipulation switch and a display that displays a timer time and power level. The knob ring 120 may rotate independent of the knob handle 110, the timer time may be set through a manipulation or rotation of the knob ring 120, and a display or display 123 may be provided at the knob ring 120 so that the timer time and the power level may be displayed on the display 123.

A knob encoder e1 may be provided to detect a rotational amount of the knob handle 110, and a knob ring encoder e2 may be provided to detect a rotational amount of the knob ring 120. The knob encoder e1 may detect a rotation amount of a gear g1 coupled to the adjustment shaft 194, and the knob ring encoder e2 may sense or detect rotation of a knob ring gear or second gear g2 provided at a actuating ring 150.

The knob handle 110 and the knob ring 120 may be provided at or on an outside of a front panel c of the cooking apparatus 10. The knob handle 110 and the knob ring 120 may be provided to pass through a space or hole h in the front panel c of the cooking apparatus 10. The power level, and the timer time, for example, may be displayed on the display 123. The power level displayed on the display 123 may be detected and displayed based on the rotational amount of the knob handle 110, and the timer time displayed on the display 123 may be detected and displayed based on manipulation of the knob ring 120.

The display 123 may include a portion that displays the power level and a portion that displays the timer time, but the power level and the timer time may be selectively displayed on a single display 123. For example, if the timer time is not set, only the power level may be displayed. If the timer time is set, the power level may be displayed for a predetermined period of time and then the timer time may be displayed for a predetermined period of time.

A user may easily verify or recognize whether a displayed number represents the power level or the timer time by differentiating a light color when the power level is displayed from a light color when the timer time is displayed. For example, the power level may be displayed with a red color and the timer time may be displayed with a white color or a blue color. When both the power level and the timer time are displayed, the power level may be displayed for two seconds and then the timer time may be displayed for a next two seconds.

As described above, when both the power level and the timer time are adjusted and displayed through the knob assembly, a separate display may not be necessary at the front panel c. A structure of such a knob assembly may be applied to both an oven range provided with an oven and a cooktop including only a burner, and may have an advantage in that the knob assembly may be used as a component shared by the oven range and the cooktop.

An actuating ring 150 may be coupled to a rear surface of the knob ring 120 and may integrally rotate with the knob ring 120. A rotational amount of the actuating ring 150 may be the same as the rotational amount of the knob ring 120. By detecting the rotational amount of the actuating ring 150, a manipulation of the knob ring 120 may be detected. The knob ring gear g2 may be provided at the actuating ring 150.

A support frame 140 may be coupled to the front panel c to support the knob ring 120. The knob handle 110 and the knob ring 120 may each be coupled at aligned positions on the front panel c, and the front panel c may be made of a metal thin plate material, for example. When the hole h is formed at the front panel c and the knob ring 120 directly rotates with and rubs against the hole h, a problem in that the knob ring 120 may be cut or deformed may occur. Therefore, the support frame 140 may be coupled to and aligned with the hole h formed at the front panel c.

The support frame 140 may be provided with a guide recess corresponding to an outer diameter of the actuating ring 150 coupled to the knob ring 120. An outer circumferential surface of the actuating ring 150 may be supported by the support frame 140 and rotated to a predetermined position. A position of the knob ring 120 may be determined by the support frame 140, and the support frame 140 may be engaged with the front panel c so that the position of the knob ring 120 may be fixed with respect to the front panel c.

The support frame 140 may surround the outer circumferential surface of the actuating ring 150 and may support the actuating ring 150 to be rotatable around a predetermined shaft. The support frame 140 may be engaged with a guide rod 210 and a burner frame 200 to which the power level adjuster 190 may be fixed. The guide rod 210 may fix or couple the burner frame 200 to the support frame 140, and the support frame 140 may be fixed at a predetermined position with respect to the burner frame 200 via the guide rod 210.

A fixing frame 160 may be engaged with and fixed to the support frame 140 via a fastener, such as a screw, for example, and may prevent the actuating ring 150 from moving or escaping from the fixing frame 160 in a rearward direction toward an inside of the cooking apparatus 10. The fixing frame 160 may confine or restrict a rotational range of the actuating ring 150 and restrict the actuating ring 150 and the knob ring 120 to be rotatable only within a predetermined angle range.

The fixing frame 160 may be formed in a shape which is similar to a bow tie such that an angle between portions corresponding to wings of the bow tie may restrict the actuating ring 150 to be rotatable within the predetermined angle range and a portion connecting the wings may prevent the actuating ring 150 from escaping in the rearward direction.

A bearing shell 130 may be a bearing that allows the knob ring 120 to be smoothly manipulated. The bearing shell 130 may be provided with a cylindrical-shaped cylinder 134, and a circular plate 132 bent from the cylinder 134 to protrude in a radial direction. The cylinder 134 may be inserted between the outer circumferential surface of the actuating ring 150 coupled to the knob ring 120 and an inner circumference surface of the support frame 140, and may reduce friction between the actuating ring 150 and the support frame 140.

The circular plate 132 may be inserted between the front panel c and the knob ring 120 to reduce friction therebetween. The circular plate 132 may separate the knob ring 120 from the front panel c by a predetermined gap and may reduce generation of scratches on the front panel c due to the manipulation of the knob ring 120.

The knob ring 120 according to embodiments may provide a return or restoring type manipulation structure. The return type manipulation structure may be a structure that allows the knob ring 120 to be manipulated in a clockwise direction or a counterclockwise direction within a predetermined angle range due to an external force, and may return or restore the knob ring 120 to an original position thereof when the external force is released therefrom.

Restoring springs s1 and s2 may provide a restoring force which returns the knob ring 120 to the original position thereof. The restoring springs s1 and s2 may include a first restoring spring s1 configured to provide a restoring force in the clockwise direction and a second restoring spring s2 configured to provide a restoring force in the counterclockwise direction. When an external force is not applied to the knob ring 120, the elastic force of the first restoring spring s1 may balance with that of the second restoring spring s2 such that the knob ring 120 may be maintained at an initial position thereof.

Both ends of each of the restoring springs s1 and s2 may be fixed to the actuating ring 150 and the support frame 140 to which the fixing frame 160 is fixed. The actuating ring 150 and the knob ring 120 may integrally rotate such that the knob ring 120 may be maintained at the initial position thereof by elastic forces of the restoring springs s1 and s2, and may be rotated by a predetermined angle in the clockwise or counterclockwise direction. One or a first end of each of the restoring springs s1 and s2 may be connected to an elastic member holder 151 on the actuating ring 150, and another or second end of each of the restoring springs s1 and s2 may be connected to a first spring holder 141 of the support frame 140 and a second spring holder 142 of the support frame 140, respectively.

Figure 6:
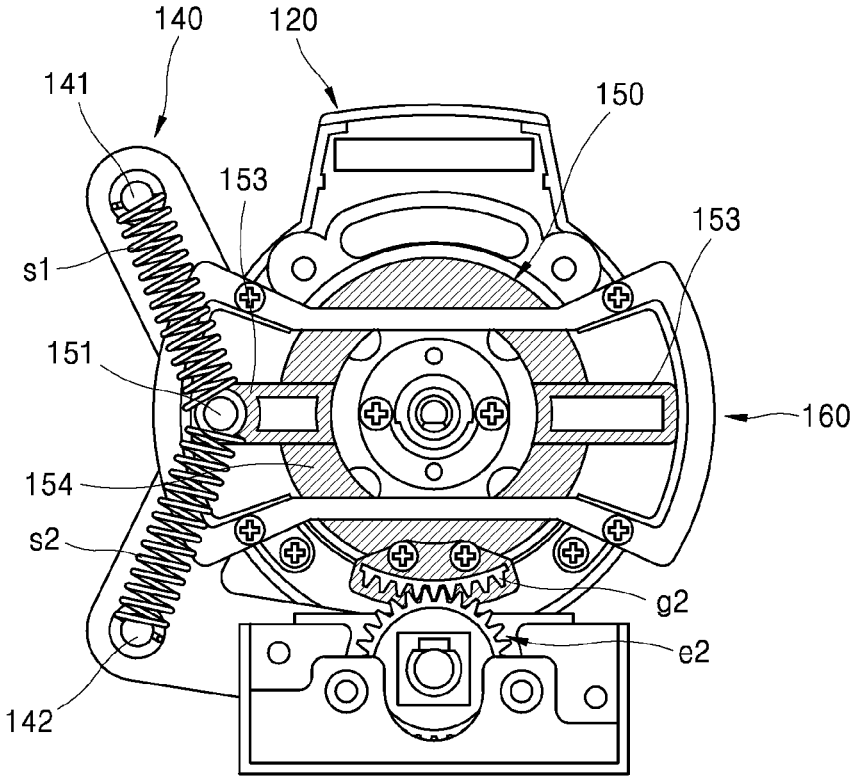
FIG. 6 is a view of a rear surface of the knob assembly of FIG. 2.
Figure 7:
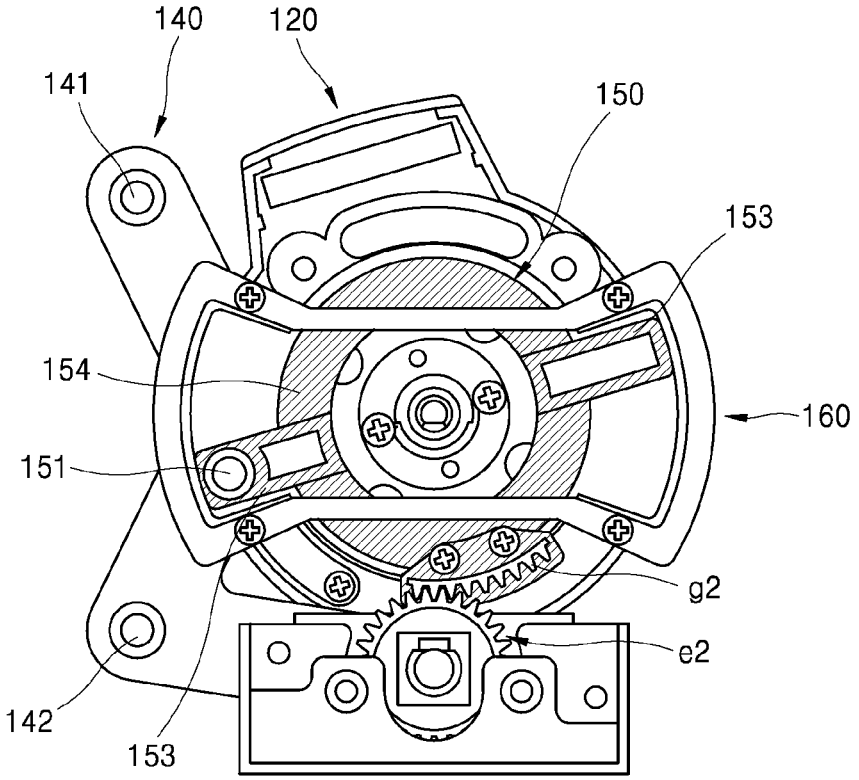
FIG. 7 and FIG. 8 are views of different manipulation states of a knob ring of the knob assembly of FIG. 2.
Figure 8:
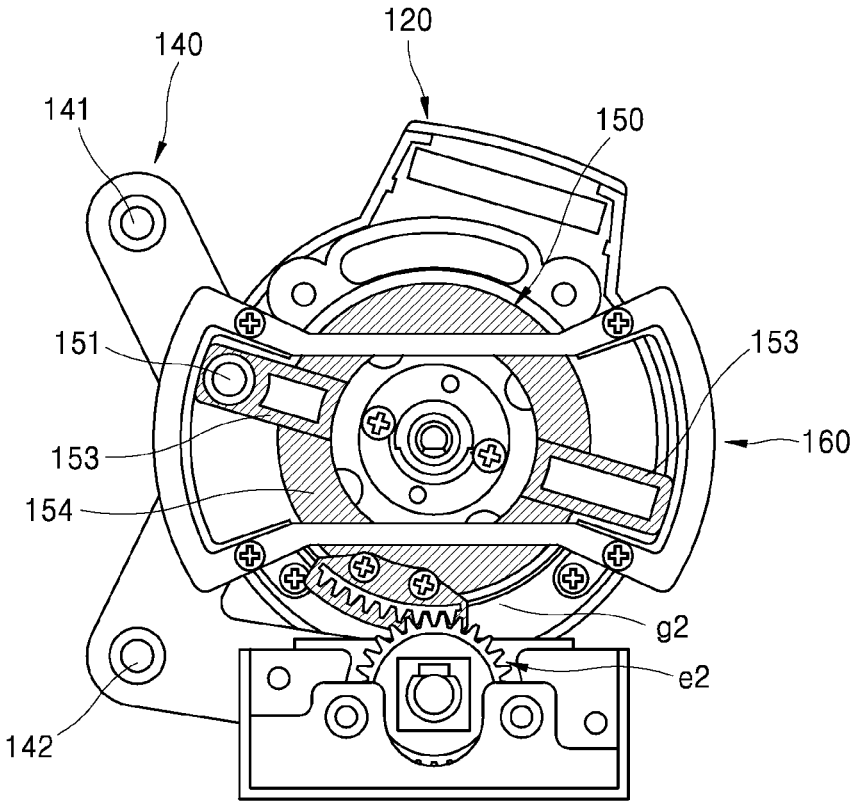
Figure 9:
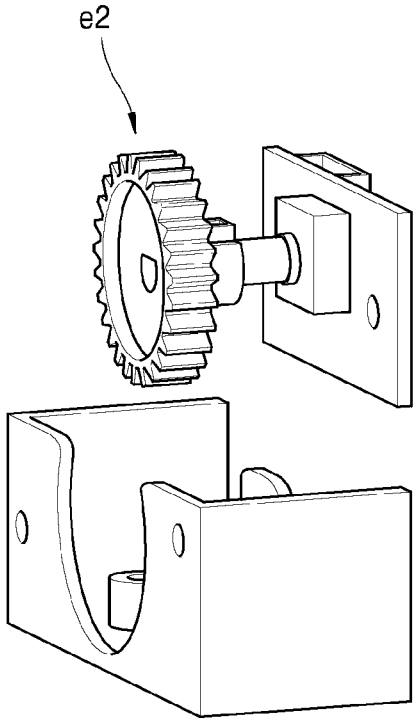
FIG. 9 is a view of a knob ring encoder of the knob assembly of FIG. 2.
Figure 10:
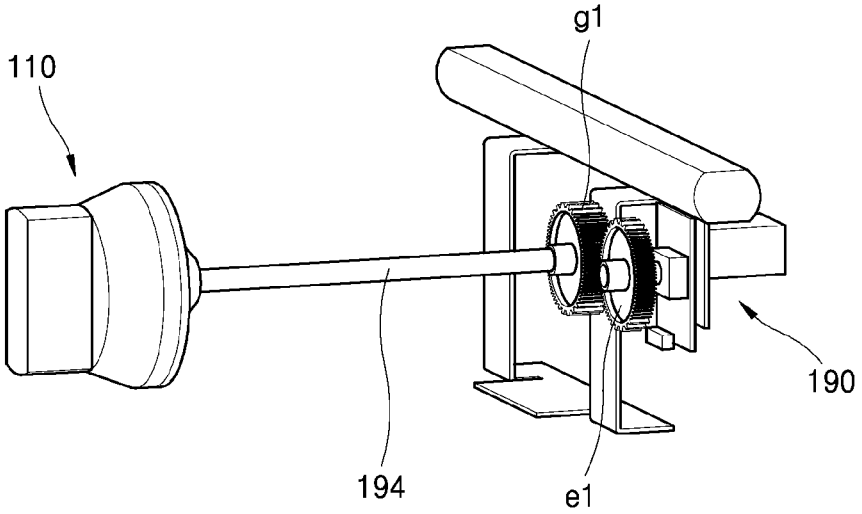
FIG. 10 is a view of a knob encoder of the knob assembly of FIG. 2.

Referring to FIG. 6 through FIG. 8, for convenience of illustration, the front panel c has been omitted from the drawings. The knob handle 110 and the knob ring 120 may be coupled to a front surface side of the front panel c, and the support frame 140, the actuating ring 150, and the fixing frame 160 may be coupled to a rear surface side of the front panel c.

The fixing frame 160 may be engaged with the rear surface of the front panel c, and the actuating ring 150 may pass through the front panel c to be engaged with the knob ring 120. A rotational center of the actuating ring 150 may be provided to coincide with an axial center of the adjustment shaft 194. The actuating ring 150 may confine the axial center of the adjustment shaft 194 to be located at a predetermined position with respect to the front panel c. That is, the actuating ring 150 may be fixed at the predetermined position with respect to the front panel c, and thus the adjustment shaft 194 may be fixed at an exact position with respect to the front panel c.

The actuating ring 150 may be inserted into the support frame 140, may pass through the front panel c, and may partially protrude from the front panel c. A front end of the actuating ring 150 may be formed in a cylindrical shape, and the cylindrical portion thereof may protrude from a front surface of the front panel c. The knob ring 120 may be coupled to the actuating ring 150 that protrudes from the front surface of the front panel c. The knob ring 120 and the actuating ring 150 may be coupled such that the knob ring 120 may be structurally supported by the support frame 140.

The manipulation of the knob ring 120 may be recognized based on rotation of the actuating ring 150. As the knob ring 120 is a portion which is exposed to the outside of the front panel c, when an encoder configured to sense the manipulation of the knob ring 120 outside of the front panel c is provided around the knob ring 120, an exterior appearance thereof is not aesthetically pleasing. As the knob ring 120 may be integrally coupled with the actuating ring 150, the knob ring encoder e2 may be provided around the actuating ring 150 to sense the rotation thereof.

The knob ring gear g2 configured to transmit a rotational angle may be provided at the actuating ring 150. The knob ring encoder e2 may be engaged with the knob ring gear g2 and configured to detect a rotational angle of the actuating ring 150. The knob ring encoder e2 may be engaged with the knob ring gear g2 and may detect a rotational manipulation signal of the knob ring 120.

The actuating ring 150 may be coupled to the pair of restoring springs s1 and s2 that return the actuating ring 150 to a predetermined position. The restoring springs s1 and s2 may connect the support frame 140 actuating ring to the actuating ring 150. When the actuating ring 150 is manipulated in the counterclockwise direction, the restoring spring s1 may provide the elastic force in the clockwise direction to return the actuating ring 150 to the original position thereof. When the actuating ring 150 is manipulated in the clockwise direction, the restoring spring s2 may provide the elastic force in the counterclockwise direction to return the actuating ring 150 to the original position thereof.

The fixing frame 160 may be provided to prevent the actuating ring 150 from escaping or moving toward the rear surface and may enable or allow the actuating ring 150 to stably operate. The fixing frame 160 may prevent the actuating ring 150 from escaping toward the rear surface by passing through a rear surface of the actuating ring 150. The fixing frame 160 may be engaged with the support frame 140. The fixing frame 160 may confine the rotational range of the actuating ring 150.

The actuating ring 150 may include a actuating ring body 154 and may be provided with a wing part or wing 153 that extends out to one side, and the actuating ring 150 may have a structure in which the pair of restoring springs s1 and s2 are fixed to the wing 153. When a rotation range of the wing 153 is restricted by the fixing frame 160, a bidirectional rotational angle of the actuating ring 150 may be constantly restricted. To more stably confine the rotation of the actuating ring 150, the wing 153 may be provided at both sides of the actuating ring 150, and the fixing frame 160 may equally restrict rotational ranges of the wings 153 provided at both of the sides.

The knob assembly according to embodiments may adjust a power level through manipulation of the knob handle 110 and may display a timer time through manipulation of the knob ring 120. Accordingly, the knob assembly may include the display 123 provided at the knob ring 120, the knob encoder e1 configured to detect manipulation of the knob handle 110, and the knob ring encoder e2 configured to detect manipulation of the knob ring 120.

The knob ring encoder e2 may be engaged with the knob ring gear g2 of the actuating ring 150 to detect rotation of the actuating ring 150. The knob ring 120 may be a returning type knob ring and may rotate within a predetermined range when an external force is applied thereto, and the knob ring 120 may return to an original position thereof when the external force is released. For example, the knob ring 120 may be manipulated to increase the timer time by being rotated a predetermined angle in the clockwise direction, and to decrease the timer time by being rotated a predetermined angle in the counterclockwise direction.

The knob handle 110 may be connected to the adjustment shaft 194 of the power level adjuster 190. The adjustment shaft 194 of the power level adjuster 190 may be a non-returning type adjustment shaft that maintains a manipulated position, and the knob encoder e1 may detect a rotational amount or a manipulated angle manipulated from a reference position. The knob encoder e1 may be engaged with the gear g1 coupled to the adjustment shaft 194 to detect rotation of the adjustment shaft 194.

Figure 11:
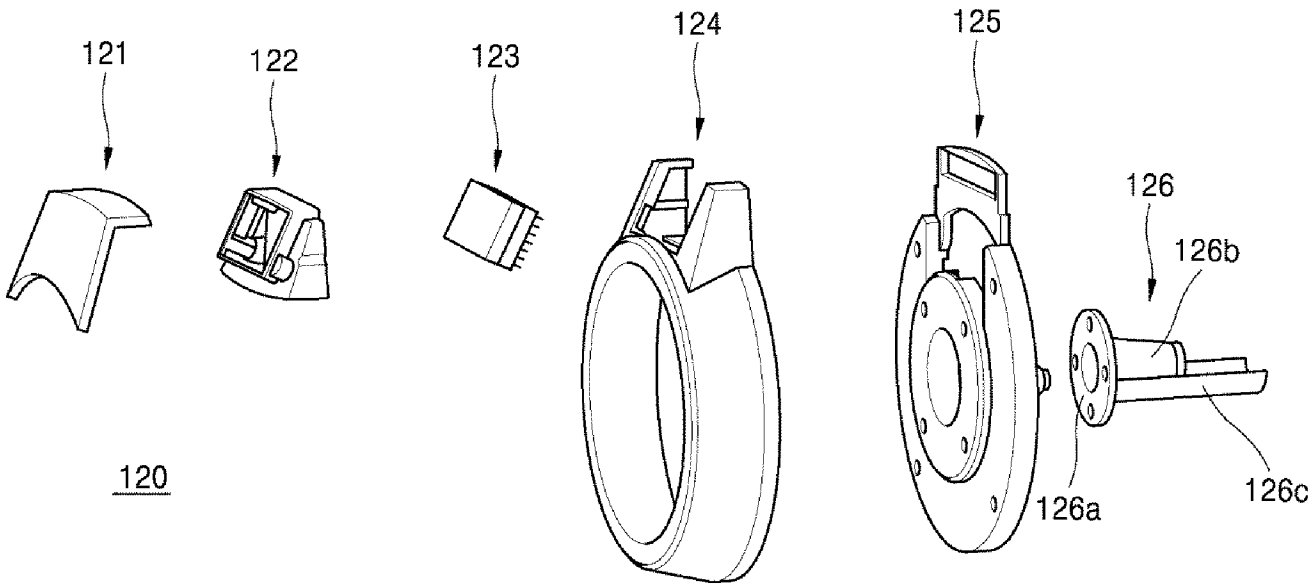
FIG. 11 is an exploded perspective view of the knob ring of FIG. 2.
Figure 12:
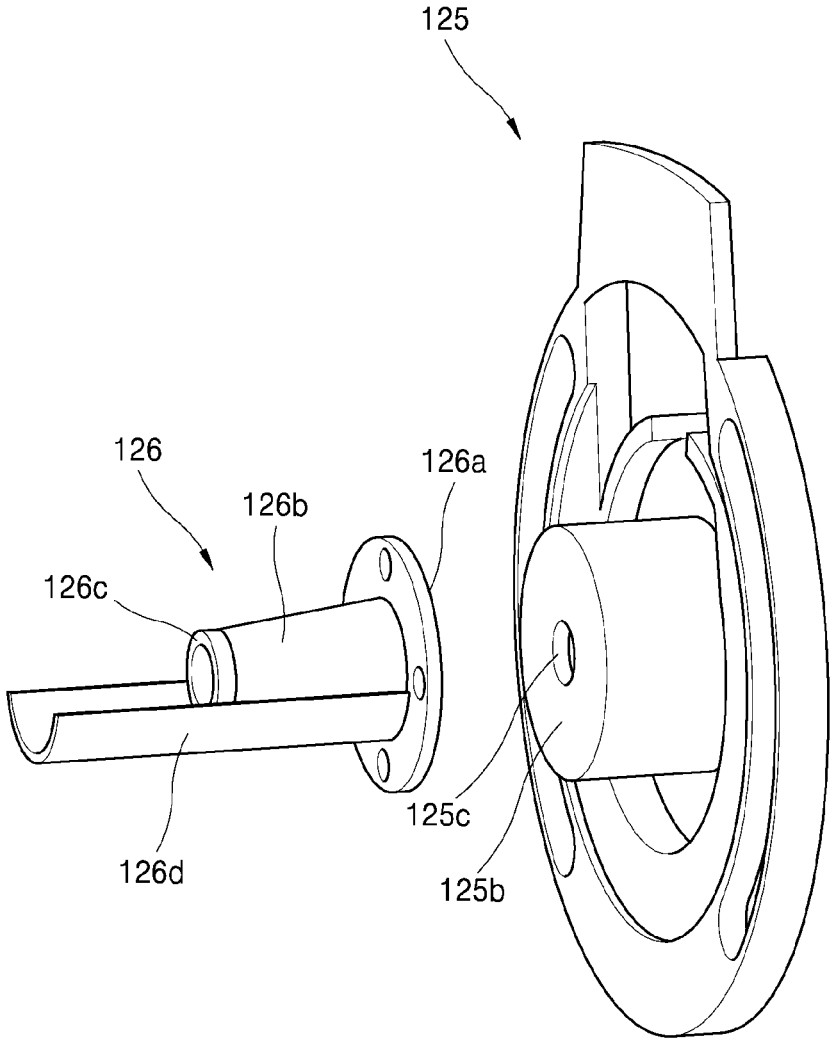
FIG. 12 is an exploded perspective view of a rear surface of components of the knob ring of FIG. 2.

In a cooking apparatus, such as a microwave oven or an induction range, in which a power level is electronically adjusted, the power level adjuster 190 may be configured with a variable resistor, for example, so that a status of the power level adjuster 190 may be detected without separately providing the knob encoder e1. Referring to FIG. 11 and FIG. 12, the knob ring 120 may include a knob ring main body 124 configured to form an exterior appearance thereof, a rear surface plate 125 coupled to a rear surface of the knob ring main body 124, and a support pipe 126 coupled to the rear surface plate 125 and configured to support the adjustment shaft 194.

The rear surface plate 125 may be provided with a rear surface plate body and a support plate 125*b* configured to enter into an interior of the front panel c and protrude toward an inner side of the cooking apparatus 10. A support hole 125*c* configured to support the adjustment shaft 194 may be provided at or in the support plate 125*b*.

The support pipe 126 may be coupled to the rear surface plate 125. The support pipe 126 may be provided with a flange 126*a* coupled to the rear surface plate 125, a tapered pipe 126*b* that extends from the flange 126*a*, and a support rib 126*d* that extends longer than the tapered pipe 126*b*. The tapered pipe 126*b* may have a tapered shape in which a diameter decreases as it extends away from the flange 126*a*, and a support part or cap 126*c* configured to support the adjustment shaft 194 may be provided at a front end of the tapered pipe 126*b*.

Thus, the adjustment shaft 194 may be structurally supported at two points, that is, the support hole 125*c* and the support cap 126*c*. In a related art valve structure, an adjustment shaft may be confined to a predetermined position, but as the adjustment shaft 194 may be a power level adjuster, a structure capable of stably supporting the adjustment shaft 194 may be required. The knob ring 120 may support the adjustment shaft 194 at two or more points. The knob ring 120 may support the adjustment shaft 194 at the two or more points as well as a front end of the gear g1 coupled to the adjustment shaft 194. The gear g1 (see FIG. 4) may be configured to transmit a rotational amount of the adjustment shaft 194 to the knob encoder e1, and the gear g1 may be supported on the support rib 126*d*.

Referring to FIG. 11, the display 123 capable of displaying the power level and timer time may be provided at the knob ring 120. The display 123 may be coupled to the knob ring main body 124 through a display housing 122, and a finishing cap 121 may be coupled to an outside of the display housing 122. The finishing cap 121 may be made of, for example, a transparent or semitransparent material to allow information displayed on the display 123 to be visible. The display 123 may be an electronic display, such as, for example, an LCD or LED device, but embodiments are not limited thereto.

Embodiments disclosed herein provide a knob assembly provided with a knob ring, which may be independently manipulated, around a knob handle so that a timer time of a cooking apparatus, such as a cooking time of a corresponding burner or an oven, may be set through a manipulation of the knob ring.

A display may be provided at the knob ring, and a power level and a timer time, for example, of a corresponding cooking apparatus may be displayed on the display so that user convenience may be improved. Further, the knob assembly according to embodiments disclosed herein may be applied to a gas range as well as a composite cooking apparatus including an oven range, an induction range, and a microwave oven, for example, so that component sharing in various cooking apparatuses may be provided.

According to embodiments disclosed herein, a knob assembly is provided that may include a knob handle coupled to an adjustment shaft that is configured to adjust power level, and a knob ring configured to surround a periphery of the knob handle, provided to pass through a front panel, configured to be rotatable independent of the knob handle, and provided with a display. The knob ring may have a returning type rotational structure in which the knob ring may return to an initial position thereof when an external force is released.

The knob assembly may further include a knob ring encoder configured to detect a manipulation of the knob ring and a knob encoder configured to detect a manipulation of the knob handle, and a power level set through a manipulation detected by the knob encoder and a timer time set through the manipulate of the knob handle may be displayed on the display.

For smooth operation of the knob handle and the knob ring, the knob assembly may further include a actuating ring coupled to the knob ring, a support frame coupled to the front panel and configured to support an outer circumferential surface of the actuating ring, and a fixing frame coupled to the support frame and configured to prevent the actuating ring from escaping from the support frame.

The knob ring may support the adjustment shaft at two or more positions thereof. The knob ring may include a knob ring main body configured to form an exterior appearance thereof, a rear surface plate coupled to a rear surface of the knob ring main body and provided with a support hole configured to support the adjustment shaft passing through the support hole, and a support pipe coupled to the rear surface plate and configured to support the adjustment shaft. The support pipe may include a flange coupled to the rear surface plate, and a tapered pipe formed to extend from the flange and provided with a support part or support configured to support the adjustment shaft.

For reducing friction when the knob ring is manipulated, the knob assembly may further include a circular plate inserted between the knob ring and the front panel, and a bearing shell provided with a cylinder which may be inserted between the actuating ring and the support frame.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

This application relates to U.S. application Ser. Nos. 15/899,507; 15/899,637; 15/899,730; and 15/899,797; all filed on Feb. 20, 2018, which are hereby incorporated by reference in their entirety. Further, one of ordinary skill in the art will recognize that features disclosed in these above-noted applications may be combined in any combination with features disclosed herein.

What is claimed is:

1. A knob assembly, comprising:

a front panel forming a front surface of a cooking appliance;

a knob provided in front of the front panel and rotatably operated by a user;

a knob ring provided between the front panel and the knob and configured to surround a periphery of the knob, the knob ring configured to be rotatable independent of the knob;

a knob ring rotation sensor disposed behind the front panel configured to sense a rotation angle of the knob ring; and a display assembly provided at an outer circumferential surface of the knob ring to rotate with the knob ring and configured to display a first information set through rotation of the knob ring.

2. The knob assembly of claim 1, wherein the first information is a timer time.

3. The knob assembly of claim 1, wherein the knob ring is moved from an initial position to a second position by an external force, and the knob ring returns to the initial position when the external force is released.

4. The knob assembly of claim 1, wherein the knob ring rotation sensor is configured to detect a manipulation of the knob ring separate from the knob.

5. The knob assembly of claim 4, further including a knob rotation sensor configured to detect a manipulation of the knob.

6. The knob assembly of claim 5, wherein the knob is coupled to an adjustment shaft configured to adjust a power level of a power source.

7. The knob assembly of claim 6, wherein the knob ring includes:

a knob ring main body configured to form an exterior appearance thereof;

a rear surface plate coupled to a rear surface of the knob ring main body and provided with a support hole configured to support the adjustment shaft which passes through the support hole; and a support pipe coupled to the rear surface plate and configured to support the adjustment shaft.

8. The knob assembly of claim 7, wherein the support pipe supports the adjustment shaft at two or more points thereof.

9. The knob assembly of claim 5, wherein the display assembly is configured to display a second information set through rotation of the knob.

10. The knob assembly of claim 9, wherein the first information is a timer time and the second information is a power level.

11. The knob assembly of claim 9, wherein the first information and the second information include a power level and a timer time.

12. The knob assembly of claim 11, wherein if the timer time is not set, only the power level is displayed, and wherein if the timer time is set, the power level is displayed for a first predetermined period of time and then the timer time is displayed for a second predetermined period of time.

13. The knob assembly of claim 11, wherein the display assembly includes a portion that displays the power level and a portion that displays the timer time.

14. The knob assembly of claim 11, wherein the power level is displayed with a red color and the timer time is displayed with a white color or a blue color.

15. The knob assembly of claim 1, wherein the knob ring includes a main body having an upper portion provided above the knob, and wherein the display assembly includes electronic display.

16. The knob assembly of claim 15, wherein the display assembly further includes a display housing provided in a recess at the upper portion of the main body, the electronic display is coupled to the upper portion through the display housing.

17. The knob assembly of claim 15, wherein the display assembly further includes a finishing cap coupled to the display housing to cover the electronic display, the finishing cap is made of a transparent or semitransparent material to allow information displayed on the electronic display to be visible.

18. The knob assembly of claim 15, wherein the upper portion of the main body is positioned at an initial position above the knob and the main body is configured to automatically return to the initial position after manipulation of the knob ring.

19. The knob assembly of claim 1, further comprising:

an actuating ring coupled to the knob ring; and a support frame configured to support an outer circumferential surface of the actuating ring.

20. The knob assembly of claim 19, further comprising:

a circular plate inserted between the knob ring and the front panel; and a bearing shell provided with a cylinder inserted between the actuating ring and the support frame.

* * * * *